US008985186B2

(12) United States Patent
Nitsche et al.

(10) Patent No.: US 8,985,186 B2
(45) Date of Patent: Mar. 24, 2015

(54) CASTING DEVICE FOR A PISTON FOR AN INTERNAL COMBUSTION ENGINE AND METHOD FOR OPENING AND/OR CLOSING A CASTING DEVICE

(75) Inventors: Frank Nitsche, Zeulenroda (DE); Achim Jager, Langlau (DE)

(73) Assignee: Federal-Mogul Nurnberg GmbH, Nuremberg (DE)

( * ) Notice: Subject to any disclaimer, the term of this patent is extended or adjusted under 35 U.S.C. 154(b) by 0 days.

(21) Appl. No.: 13/997,432

(22) PCT Filed: Nov. 18, 2011

(86) PCT No.: PCT/EP2011/070454

§ 371 (c)(1), (2), (4) Date: Jun. 24, 2013

(87) PCT Pub. No.: WO2012/084364

PCT Pub. Date: Jun. 28, 2012

(65) Prior Publication Data

US 2013/0284393 A1 Oct. 31, 2013

(30) Foreign Application Priority Data

Dec. 23, 2010 (DE) ..... 10 2010 064 078

(51) Int. Cl.

| | |
|---|---|
| ***B22C 9/06*** | (2006.01) |
| ***B22D 15/02*** | (2006.01) |
| ***B22D 17/22*** | (2006.01) |
| *F02F 3/00* | (2006.01) |

(52) U.S. Cl.

CPC . *B22C 9/062* (2013.01); *B22C 9/06* (2013.01); *B22D 15/02* (2013.01); *B22D 17/22* (2013.01); *F02F 3/00* (2013.01)

USPC ..... 164/137; 164/340; 164/341

(58) Field of Classification Search

CPC ..... B22C 9/06; B22C 9/062; B22D 15/02; B22D 17/22; F02F 3/00

USPC ..... 164/137, 340, 341, 342

See application file for complete search history.

(56) References Cited

U.S. PATENT DOCUMENTS

| | | | | |
|---|---|---|---|---|
| 3,836,294 | A | 9/1974 | Steinwart et al. | |
| 5,311,918 | A * | 5/1994 | Scott | 164/63 |
| 6,467,396 | B1 | 10/2002 | Issler | |
| 6,546,993 | B1 * | 4/2003 | Tilch | 164/132 |

(Continued)

FOREIGN PATENT DOCUMENTS

| | | |
|---|---|---|
| DE | 1097091 B | 1/1961 |
| DE | 199 22 809 A1 | 11/2000 |

(Continued)

*Primary Examiner* — Kevin P Kerns

(74) *Attorney, Agent, or Firm* — Robert L. Stearns; Dickinson Wright, PLLC

(57) ABSTRACT

A piston for an internal combustion engine includes a mostly linearly displaceable sleeve for forming at least one piston pin bore and at least one slider that can be displaced at least mostly linearly and diagonally to the sleeve for forming at least one recess under a ring zone of the piston. The sleeve and the slider are at least indirectly coupled, such that the sleeve at least partially carries the slider when displaced. A method for opening and/or closing a casting device for a piston for an internal combustion engine, wherein a mostly linearly displaceable sleeve at least partially carries a slider that can be displaced mostly linearly and diagonally to the sleeve.

6 Claims, 2 Drawing Sheets

(56) References Cited

U.S. PATENT DOCUMENTS

| | | | | |
|---|---|---|---|---|
| 7,213,562 | B2 * | 5/2007 | Schnaitmann | 123/193.6 |
| 2008/0257518 | A1 | 10/2008 | Frank et al. | |

FOREIGN PATENT DOCUMENTS

| | | | |
|---|---|---|---|
| DE | 102008048497 | A1 | 4/2010 |
| JP | 2001 150097 | A | 6/2001 |

* cited by examiner

CASTING DEVICE FOR A PISTON FOR AN INTERNAL COMBUSTION ENGINE AND METHOD FOR OPENING AND/OR CLOSING A CASTING DEVICE

CROSS REFERENCE TO RELATED APPLICATIONS

This application is a 371 of PCT/EP2011/070454 filed Nov. 18, 2011, which claims priority from DE 10 201 0 064 078.6 filed on Dec. 23, 2010, the disclosures of which are incorporated herein by reference.

BACKGROUND OF THE INVENTION

1. Technical Field

The invention is directed toward a casting device for a piston for an internal combustion engine as well as a method for opening and/or closing a casting device.

2. Related State of the Art

When casting pistons for internal combustion engines, one particular challenge is to form the piston with as few lost cores as possible in a form that has to be reworked as little as possible and has been optimized as regards savings in weight.

To form grooves below the ring zone of the piston, it is known from DE 199 22 809 A1 to provide, along with a linearly displaceable sleeve, a pivotal core for the formation of such a groove.

According to US 2008/0257518 A1, suitable cores for the formation of the grooves below the ring zone, which are used as cooling grooves, are displaced for the most part linearly and obliquely as regards the sleeves.

SUMMARY OF THE INVENTION

A simplified device and a method for casting a piston for an internal combustion engine is provided. Such allows, to the extent possible the formation of recesses to save weight.

Accordingly, this device comprises at least one, mostly linearly displaceable sleeve for the formation of at least one piston pin bore. The sleeve is therefore a component that comprises at its end directed at the casting space an essentially cylindrical portion that leaves a space for the piston pin bore on the finished piston. In particular, the sleeves can have on the portions facing away from the casting space sections with a larger diameter, and the sleeves can comprise measures for coupling with a drive or, as described below, for coupling at least indirectly with the slider.

With the casting device as according to the invention, at least one slider displaceable mostly linearly and obliquely towards the sleeve is provided namely for formation of at least one recess below the ring zone on the piston. The path of displacement of the slider is a result of the fact that the recesses below the ring zone typically extend below an acute angle towards the piston axis and thus extend obliquely towards the axis of the sleeves extending perpendicular to the piston axis. The sleeve is at least indirectly coupled to the slider such that during displacement the sleeve entrains the slider at least in part. This coupling can be formed during the opening of the casting device, for example, such that the sleeve is initially retracted at least a short distance, and then a section on the sleeve engages at least indirectly with the slider such that this is displaced obliquely towards the sleeve. In other words, the sleeve is coupled in particular for the opening movement in such a manner to the slider that it "entrains" this as part of a pulling movement. Moreover, this coupling can also be effective during closure as part of a "pressing" movement.

When closing the casting device, the operation can be carried out essentially in reverse, with it presently being preferred to effect a movement of the slider back into its closed position over substantially the entire closure movement of the sleeve. The slider expediently has a projection that forms the positive form of the desired recess and is designed to broaden in the movement direction for a particularly simple retraction during opening of the form. The casting device also comprises any form (halves) that are required for casting a complete piston. Furthermore, both the sleeves as well as the slider are provided preferably twice in order to form the necessary configurations on both sides of the piston. Finally, the sleeve can extend through an opening in the slider. Advantageously, conventional casting devices do not have to be re-configured. There is furthermore the advantage over a pivoting movement of casting cores for formation of recesses below the ring zone that the recesses can be designed to be deeper, and by this a more extensive savings in weight is possible.

Preferably, the slider is guided in at least one guide. By this, the movement of the slider can be defined particularly exactly. At the same time the coupling with the sleeve can take place flexibly within a certain framework such that the guide can be designed to be exchangeable and/or variable, for example with regard to the angle, without having to change the coupling with the sleeve.

Accordingly, it is furthermore preferred that the guide is exchangeable. This offers the advantage to be able to adjust the path of displacement of the slider to the various piston geometries. Alternatively or supplementing this, the angle provided by the guide can be variable as regards the displacement path of the sleeve.

For the coupling between the sleeve and the slider, what is called a pivoting fork is presently preferred, with which the slider is at least indirectly connected and is pivotably connected at least to a certain extent. For this, the pivoting fork can be pivoted by the sleeve such that the sleeve "entrains" the slider by means of the pivoting fork.

In particular in view of the possibility to alter the displacement path of the slider by exchanging at least one guide and/or setting a different angle, it is advantageous if the slider is furthermore coupled displaceably at least to a minor extent to the pivoting fork.

In view of the coupling between the sleeve and the slider by means of the pivoting fork, presently at least a peg on the sleeve is furthermore preferred which can made to engage with a projection and/or a sliding surface on the pivoting fork. The engagement with a projection is presently preferred for the entrainment during opening, while cooperation with a sliding surface during the closure movement offers advantages.

The solution of the above-mentioned object is achieved in addition by a method according to which a sleeve displaceable for the most part linearly entrains at least in part at least one slider that is displaceable mostly linearly and obliquely to the sleeve. The preferred further embodiments of the device can be applied to the method as according to the invention. Furthermore, any method features described in connection with the device can be used with the method.

BRIEF DESCRIPTION OF THE DRAWINGS

An embodiment of the invention shown as an example in the drawings will be explained below in which.

DETAILED DESCRIPTION OF A PREFERRED EMBODIMENT OF THE INVENTION

Figure 1:
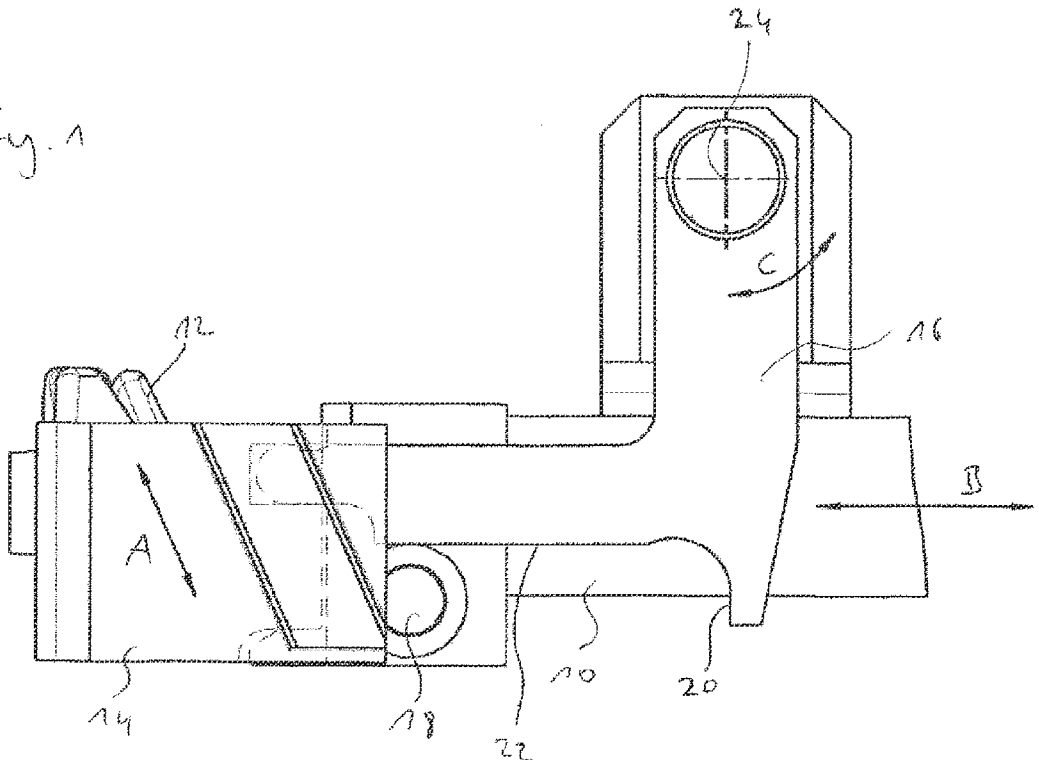
FIG. 1 shows a lateral view of a part of the casting device according to the invention.

In FIG. 1, a section of the casting device is shown, with in the first place a guide 14 for the linear movement of a slider 12 in the direction A being recognizable in the lateral view of FIG. 1. Furthermore, an area of the sleeve 10 displaceable in the direction B is recognizable in FIG. 1, which is turned away from the casting space (according to FIG. 1 to the left). Therefore, the directions A and B are oblique in relation to each other. As will be explained in more detail below, the sleeve 10 and the slider 12 are coupled by means of a pivoting fork 16 that is pivotable about an axis 24 in a direction C. Said coupling is carried out in the example shown via a peg 18 that can be engaged during the opening with a projection 20 on the pivoting fork 16 and during closure with a sliding surface 22 on the pivoting fork.

Furthermore, it can be seen in FIG. 2 that corresponds to the condition of FIG. 1 that the sleeve 10 extends through an opening in the slider 12, and that according to the figures the slider 12 has in the upper region a nose-like projection 26 for formation of a recess below the ring zone of a piston.

Figures 2, 3, 4, 5, 6, 7:
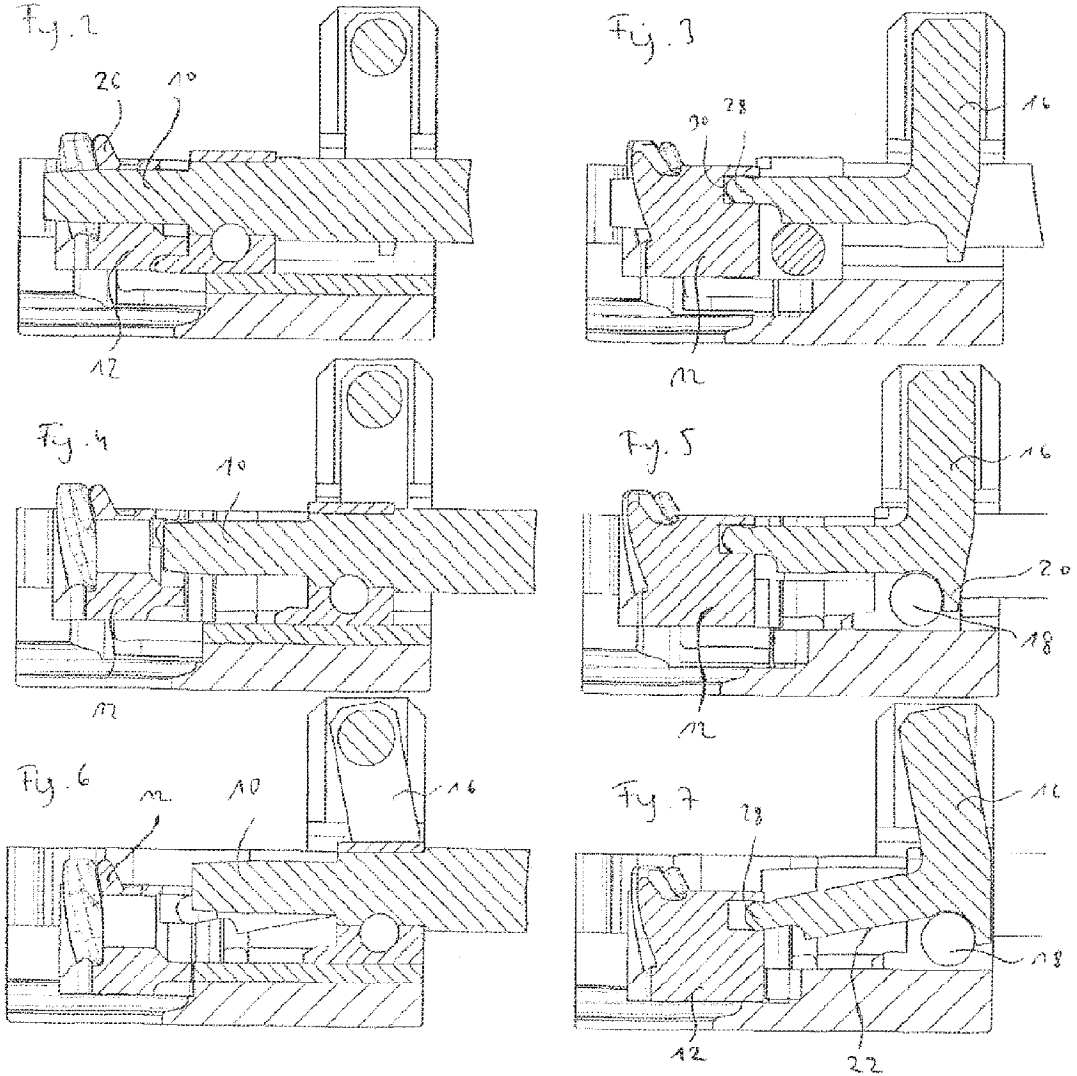
FIG. 2 shows a first cut view of the casting device shown in FIG. 1 in a closed condition.
FIG. 3 shows a second cut view of the casting device shown in FIG. 1 in a closed condition.
FIG. 4 shows a first cut view of the casting device shown in FIG. 1 in a condition of the sleeve retracted in part.
FIG. 5 shows a second cut view of the casting device shown in FIG. 1 in a condition of the sleeve retracted in part.
FIG. 6 shows a first cut view of the casting device shown in FIG. 1 in a condition of the sleeve retracted in full.
FIG. 7 shows a second cut view of the casting device shown in FIG. 1 in a condition of the sleeve retracted in full.

Furthermore, the coupling between the slider 12 and the pivoting fork 16 can be seen in FIG. 3, which consists in that a broadened, free end 28 of the pivoting fork 16 is placed in a space 30 in the slider such that a linear movement can be transferred, that further, as is recognizable from FIG. 7, a minor pivot movement is possible, and further a certain linear displacement is allowed (according to the figures from the right to the left). This movability is favorable owing to the determination of the movement of the slider by the guide (see FIG. 1) since with said degrees of freedom between the slider and pivoting fork the movement of the slider can be defined by the guide, however, it can be transferred by the pivoting fork to the slider.

While FIGS. 2 and 3 correspond to the closed condition of the casting device, and both the sleeve as well is also the slider are in a casting position, an intermediate position is shown in FIGS. 4 and 5 in which the casting device is still closed, however the sleeve 10 is retracted in part while the slider 12 is still in a casting position. In FIG. 5 it can be seen that the peg 18 on the sleeve just comes into engagement with the projection 20 on the pivoting fork 16 in order to begin the entrainment of the slider 12.

The end position is to be found in FIG. 6, in which the sleeve 10 is retracted to its maximum extent, the slider is freely movable and the casting device can thus be opened. It can be seen from the position of the pivoting fork 16 that this was pivoted at least to a minor extent counter-clockwise, and has thereby entrained the slider, as is shown in particular in FIG. 7, the movement of which is still defined by the guide 14 (see FIG. 1). Since in the example shown, the path of displacement of the slider is comparatively steep, the free end 28 of the pivoting fork 16 has moved slightly out of the space 30 of the slider 12.

When the casting device, starting with the condition shown in FIG. 7, is supposed to be closed, the sleeve will be displaced again into the condition shown in FIGS. 1 through 3. The peg 18 slides hereby on the sliding surface 22 off of the pivoting fork which, as a consequence of this, returns the slider 12 to the fully retracted position.

The invention claimed is:

1. A casting device for a piston for an internal combustion engine, having at least one primarily, linearly displaceable sleeve for forming at least one piston pin bore and at least one slider that is displaceable substantially linearly and obliquely towards the sleeve for forming at least one recess below a ring zone of the piston, wherein the sleeve and the slider are coupled directly or indirectly such that during displacement the sleeve entrains the slider at least partially; and wherein the slider is coupled directly or indirectly and pivotally to a pivoting fork which is pivotable by the sleeve.

2. The casting device according to claim 1, wherein the slider is guided in at least one guide.

3. The casting device according to claim 2, wherein the guide is exchangeable and/or its angle is variable.

4. The casting device according to claim 1, the slider is further coupled slightly displaceably to the pivoting fork.

5. The casting device according to claim 1, wherein the sleeve comprises a peg which is engageable at the pivoting fork with a projection and/or a sliding surface.

6. A method for opening and/or closing a casting device for making a piston for an internal combustion engine comprising the steps of:

preparing a sleeve and a slider operably coupled with the sleeve;

displacing the sleeve in a linear direction to form a pin bore in the piston;

displacing the slider in a direction that is oblique to the linear direction to the sleeve in response to displacing the sleeve in the linear direction to form a recess in the piston; and wherein the slider is coupled directly or indirectly and pivotally to a pivoting fork which is pivotable by the sleeve.

* * * * *